United States Patent [19]

Hunt

[11] Patent Number: 4,979,502

[45] Date of Patent: Dec. 25, 1990

[54] COMBINED MASSAGE AND HEATING DEVICES

[76] Inventor: Troy T. Hunt, Rte. 3 Box 369, Midway, Ga. 31320

[21] Appl. No.: 294,919

[22] Filed: Jan. 6, 1989

Related U.S. Application Data

[63] Continuation-in-part of Ser. No. 121,035, Jan. 15, 1988, abandoned.

[51] Int. Cl.[5] ..... A61H 1/00

[52] U.S. Cl. ..... 128/24.1; 128/32; 128/68.1

[58] Field of Search ..... 128/24.1, 68.1, 32

[56] References Cited

U.S. PATENT DOCUMENTS

| | | | |
|---|---|---|---|
| 2,657,684 | 11/1953 | Avery | 128/24.1 |
| 2,792,830 | 5/1957 | Dacey | 128/24.1 |
| 3,035,571 | 5/1962 | Jones | 128/32 |
| 3,481,326 | 12/1969 | Schamblin | 128/32 |
| 3,981,032 | 9/1976 | Brooks | 128/33 |
| 4,116,233 | 9/1978 | Scaduto | 128/32 |
| 4,136,685 | 1/1979 | Ramey | 128/33 |
| 4,343,303 | 8/1982 | Williams | 128/32 |
| 4,513,735 | 4/1985 | Friedson et al. | 128/32 |
| 4,513,736 | 4/1985 | Thurber | 128/24.1 |
| 4,553,534 | 11/1985 | Stiegler | 128/24.1 |
| 4,559,929 | 12/1985 | Hseu | 128/33 |
| 4,574,787 | 3/1986 | Jacobs | 120/32 |
| 4,607,624 | 8/1986 | Jefferson | 128/24.2 |
| 4,702,235 | 10/1987 | Hong | 128/68.1 |
| 4,732,140 | 3/1988 | Stoffregen | 128/32 |

FOREIGN PATENT DOCUMENTS

| | | | |
|---|---|---|---|
| 125589 | 8/1928 | Switzerland | 128/24.1 |

*Primary Examiner*—Edgar S. Burr
*Assistant Examiner*—Aaron J. Lewis
*Attorney, Agent, or Firm*—Watson, Cole Grindle & Watson

[57] ABSTRACT

A vibrator/heating apparatus is adapted to provide selected and variable vibration and/or heat to specific portions of the human body using respective vibrator and heaters and respectively controlled by first and second manually operable controllers and powered by ac/dc converters to apply power to the controllers and the vibrator, heater, controller and power supply are mounted to housing that conforms to a particular part of the human body.

5 Claims, 2 Drawing Sheets

COMBINED MASSAGE AND HEATING DEVICES

CROSS-RELATED INVENTIONS

This invention is a Continuation-in-Part application of application Ser. No. 121035, filed Jan. 15, 1988 and now abandoned.

BACKGROUND OF THE INVENTION

1. Field of the Invention

This invention relates to message and heating apparatus, and in particular to such apparatus provided in a number of different sizes and shapes to accommodate different portions of the human body such as the back, chest, neck, waist, arms and legs and which is operable from either a battery or regular 120 volt ac power source.

2. Related Art

U.S. Pat. No. 3,981,032 discloses a neck pillow device having a pair of vibrators mounted in a pillow such that a vibrating device is mounted on either side of the head of the user. A face pillow is positioned alongside a corresponding one of the vibrators with the respective vibrator interposed between the corresponding face pillow.

U.S. Pat. No. 4,136,685 discloses a combination of a pressure-switch operated vibrating motor within a cushioning material such that a pressure switch is activated by the force of a person applying pressure on the pillow to activate the vibrating motor.

U.S. Pat. No. 4,559,929 discloses a message device in the form of a pillow with a cavity for two spaced vibrator devices disposed therein to provide a vibratory massaging effect throughout the pillow.

U.S. Pat. No. 4,607,624 discloses a combined massaging pad and heating pad for application to the body in a single conveniently portable package which is operable from either alternating or dc current power sources.

SUMMARY OF THE INVENTION

There is need for an improved message and heating apparatus, and in particular such a device that is more adaptable to treat various different portions of the human anatomy such as the chest, waist, arm and legs.

Moreover, there is a need for a combined heating and vibrator apparatus that provides adjustable independent control of both the heat and amount of vibration in accordance with the needs of the user.

The heat and vibrator apparatus of the present invention enables the user to select a particular size and shape of the heat and vibrator mechanism to accommodate a particular area of the body such as the arm, chest, waist or leg, etc., thereby enabling an improved application of heat and/or vibration to sooth muscles in the affected area and provide relief from strain and tension.

BRIEF DESCRIPTION OF THE DRAWINGS

The above objects, advantages and objects are readily apparent from the following description of the best mode of carrying out the invention when taken in conjunction with the drawings, wherein.

DETAILED DESCRIPTION OF THE INVENTION

Figure 1:
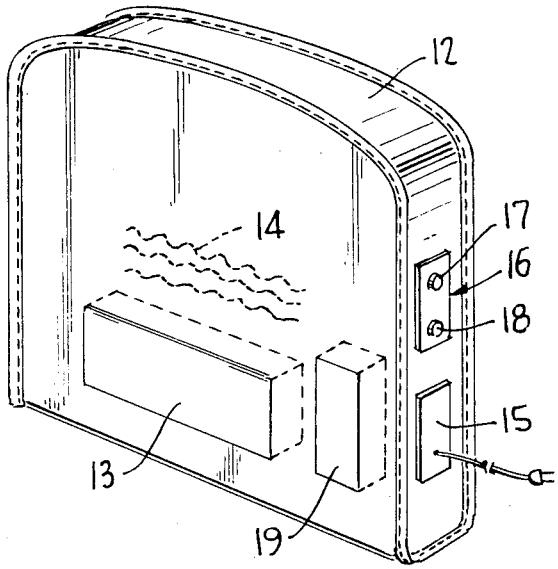
FIG. 1 illustrates the essential components of the invention and as they are embodied in a pillow.

FIG. 1 shows the essential components of the invention wherein vibrator 13, heater filaments 14, adapter 15 and controller 16 with control knobs 17 and 18 are mounted within the cushion 12 in a manner known to those skilled in the art of message/heating elements. Vibrator 13 is controlled by controller knob 17 and heating elements 14 are controlled by controller knob 18. The magnitude of the oscillations of vibrator 13 is controlled by the rotation of controller knob 17. Rotation of controller knob 18 causes greater or lesser heat to be emitted by heater filaments 14. Alternatively both the magnitude and frequency of vibrator 13 may be controlled. Both vibrator 23 and heating elements 14 as well as the means to control them by controller 16 are well known to those skilled in this art.

Power is applied to controller 16 via adapter 15 which supplies a 12 volt dc output and is alternatively connected to (1) a 120 volt ac plug; (2) the battery of a car through the electric lighter assembly; or (3) batteries either mounted internally or externally to cushion 12. For the latter purpose battery pouch 19 is provided and as shown in FIG. 1, the battery pouch 19 is mounted within pillow 12.

The above components are used in each of the embodiments of the invention described herein. Their operation is believed to be sufficiently well known such that a detailed elaboration of the manner of their interconnection is not necessary to enable the invention to be practiced.

All of the embodiments of the invention are adapted to be energized in the same manner as described above, although in some instances, because of size limitations of the particular embodiment, certain components such as the batteries are mounted externally of the message/-vibrator apparatus.

It is preferable that the eight batteries within battery power pack 19 be rechargeable batteries. Eight batteries connected in series are required to provide the 12 volt output necessary for operation of the heater filaments and the vibrator with the apparatus not being connected to an external power source such as a wall outlet of 115V ac, or alternatively to the cigarette accessory outlet of an automobile.

Figure 2:
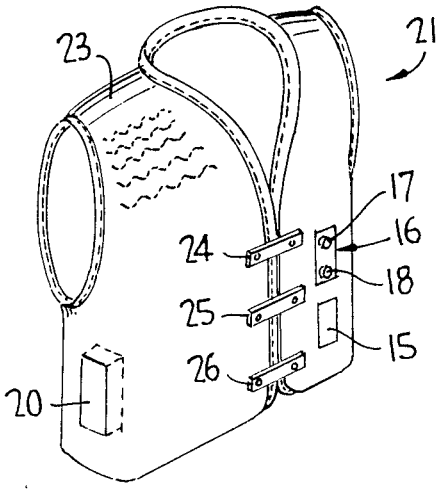
FIG. 2 illustrates the invention as it is embodied in a vest.

A vest 21, including vibrator 22, heating elements 23 and adapter 15 is shown in FIG. 2. Vest 21 is held in place on an individual by fasteners 24, 25 and 26, which may be of the hook, or button type, or even velcro type. An individual wearing vest 21 controls operation of vibrator 22 and heating elements 23 by a controller similar to that of controller 16 shown in FIG. 1. The magnitude and frequency of the vibrations from vibrator 22 are controlled by rotary switch 17 and the amount of heat generated by heating elements 23 is controlled by rotary switch 18, whereby, for example, three different levels of heat are selectable from heating elements 23 through the setting of rotary switch 18. It is understood that heating elements 23 may be located throughout the entire vest or only in a portion thereof as shown in FIG. 2. Similarly the vibrator 22 may extend only over a portion of vest 21 or may be located in other areas of the vest designated in FIG. 2.

Figure 3:
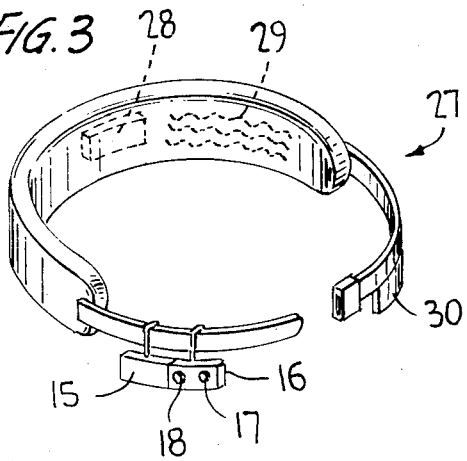
FIG. 3 illustrates the invention as it is embodied in a waist belt.

FIG. 3 shows an exemplary embodiment of the invention in the form of a belt 27 designed to be worn around the waist of an individual and including both a vibrator 28 and heating elements 29. A controller similar to 16 of FIG. 1 and an adapter similar to adapter 15 of FIG. 1 are designed to be attached to the belt rather than built into belt 27 itself. Also, the batteries are located in a pouch 30 that is attached to the belt rather than being incorporated into the belt itself, and which preferably includes the adapter 15 and controller 16.

Figure 4:
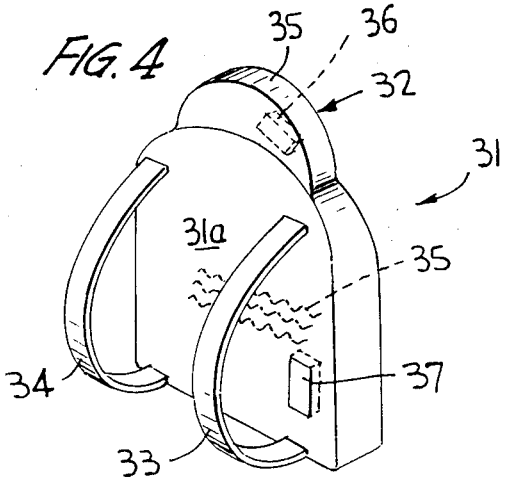
FIG. 4 illustrates the invention as it is embodied in a knapsack with a raised neck portion.

FIG. 4 illustrates a knapsack 31 with neck portion 32 and carrying straps 33 and 34. Heating elements 35 are included as shown in the figure, although it is understood that the location of heating elements is not limited to that shown in FIG. 3. Similarly the vibrators 36 and 37 are mounted respectively in the neck portion 35 of the knapsack 34 and in the back portion 31*a*. Carrying straps 33 and 34 may be adjustable in a manner known to those skilled in the art so that the knapsack will accommodate a large number of individuals of different size and weight. The vibrators 36 and 37 and heating elements 35 are controlled as mentioned previously.

Figure 5:
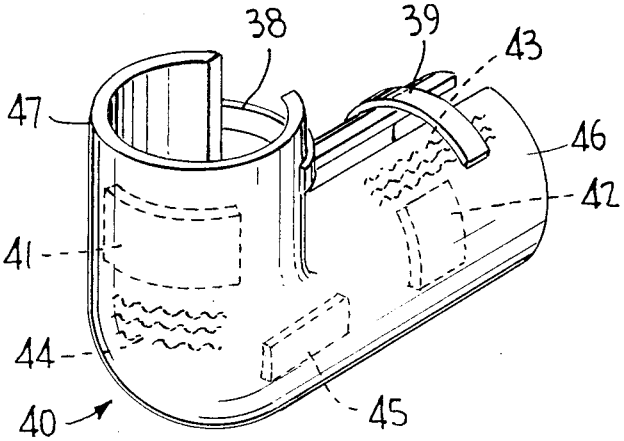
FIG. 5 illustrates the invention as it is embodied in a device for application to a foot.

FIG. 5 shows another embodiment of the invention in which the ankle and foot of an individual may be encased to provide a message and/or heat to the ankle and or foot of the individual. Ankle/foot casing 40 includes closure straps 38 and 39. Vibrators 41, 42 and heating elements 43, 44 are mounted within the ankle/foot vibrator 40 and individually controlled by control unit 45 as illustrated in FIG. 5. It is apparent that foot section 46 can be made longer so that it completely surrounds the foot. Similarly ankle section 47 can be made longer so that it encases both the ankle and calf of the foot.

Figure 6:
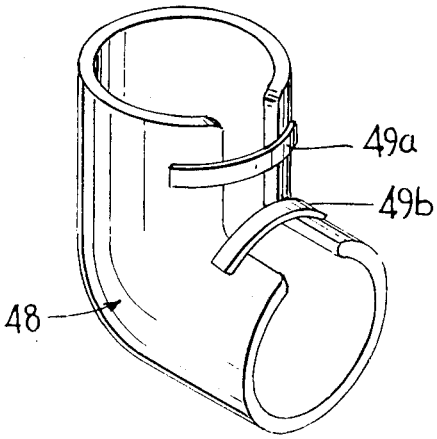
FIG. 6 illustrates the invention as it is embodied in a device for application to an ankle.

FIG. 6 shows a modification of the ankle/foot device of FIG. 5 in which only the ankle is accommodated. Thus, ankle casing 48 includes straps 49*a* and 49*b* as shown in FIG. 6. The vibrator and heating elements (not shown) are controlled as those components are controlled in FIG. 5.

Figure 7:
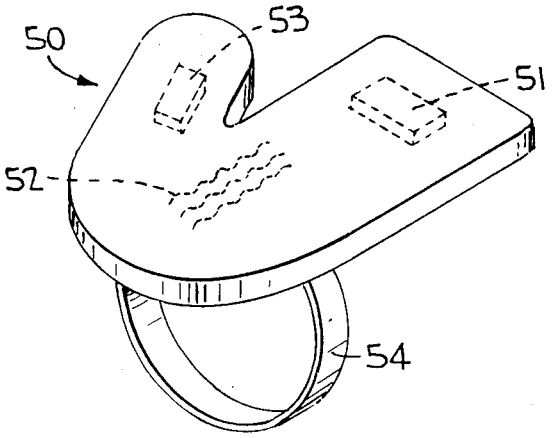
FIG. 7 illustrates the invention as it is embodied in a device for application to a hand.

FIG. 7 shows an embodiment 50 of the invention shaped to provide heat and/or vibration to the hand of a user by vibrator 51 and heating elements 52 controlled by control unit 53. Vibrator/messager 50 is held on the hand by strap 54.

Figure 8:
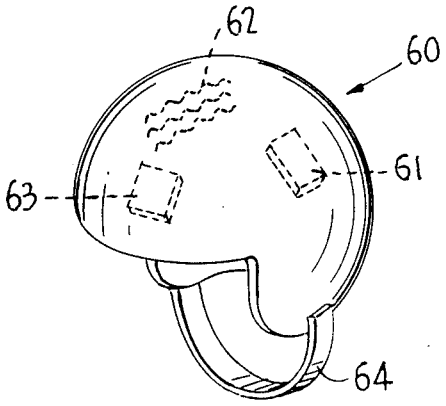
FIG. 8 illustrates the invention as it is embodied in a device for application to the head.

FIG. 8 shows an embodiment of a head vibrator and heat unit 60, again containing both vibrator 61 and heating elements 62 controlled by controller 63 and held in place by strap 64.

Figure 9:
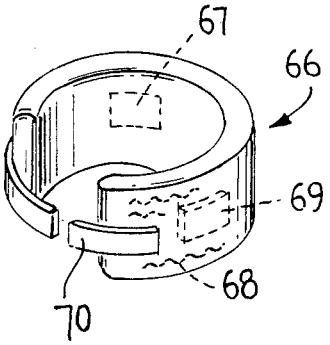
FIG. 9 illustrates the invention as it is embodied in a device for application to the neck.

FIG. 9 shows yet another embodiment of the invention in the form of a neck vibrator/heater unit 66, including vibrator 67 and heating elements 68, both controlled by control unit 69. Strap 70 enables the unit 66 to be held in place with control unit 69 being within reach of the user to operate the controls.

Figure 10A:
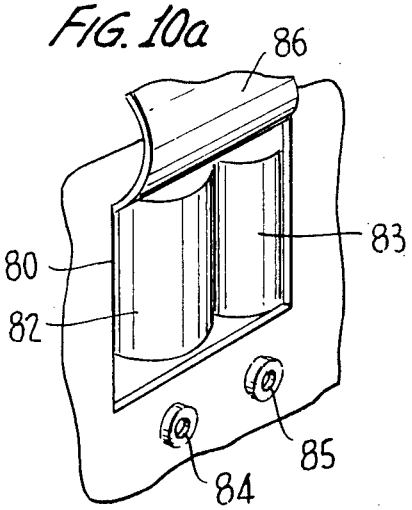
FIGS. 10A and 10B illustrate respectively different ways of inserting batteries into the devices of the invention.
Figure 10B:
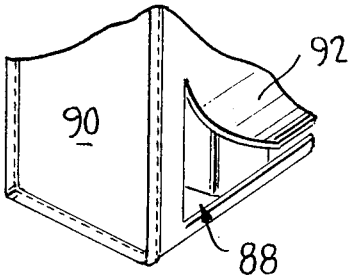

Several embodiments of a pouch for retaining the batteries are shown in FIGS. 10*a* and 10*b*. In FIG. 10*a* the batteries 82, 83 are shown mounted within pouch 80 with terminals 84 and 85 accessible to the outside for connection to a controller unit (not shown). Flap 86 is lowered to cover the batteries during normal use of the vibrator/massager unit to which the batteries are attached. Only two batteries are shown for the sake of clarity, it being understood that there is space for eight batteries within pouch 80. Battery pouch 80 is designed for outside attachment to a vibrator/message unit and can be, for example hung from the belt or external surface of the unit in proximity to the control unit thereof to avoid the need for lengthy lines interconnecting the batteries and the control unit.

In the embodiment of FIG. 10*b* the battery compartment 88 is contained within the bottom, side portion of cushion 90 with liftable flap 92 covering the battery compartment during use of the vibrator/messager unit 90.

It is to be understood that there are modifications and alterations of the above-described embodiments that are readily apparent to those ordinary skill in the massage/-vibrator apparatus art, which modifications and alterations are intended to be within the scope of coverage of the following claims, and therefore the following claims are only intended to be limited by the equivalents of the terms set forth therein.

What is claimed is:

1. Apparatus adapted to provide selected and variable vibration and/or heat to the upper portions of the human body, comprising:

vibrator means for producing vibrations of selected frequency and amplitude;

first manually operated means for controlling the frequency and amplitude of said vibrator means;

battery power supply means for supplying electric power to said first means for controlling;

heating means for producing a controlled amount of heat;

second manually operated means for controlling said heating means to produce heat output over several levels of heat;

means for housing said vibrator means and said first and second manually operated means, and being in the form of a vest to conform to the upper portions of the human body to conduct the vibrations and heat to said upper part of the human body, said housing means including a battery compartment removably inserted within said housing means for retaining a plurality of battery components, and terminals mounted on an external surface of said battery component and electrically connected to said plurality of batteries and to said means for controlling;

said heating means and said second controlling means being retained in said vest and electrically connected with said plurality of battery components; and said battery compartment further including an opening onto an external surface of said housing and a movable flap for covering said opening in said battery compartment.

2. Apparatus as claimed in claim 1 wherein said first and second manually operated means are mounted on the front of said vest to be accessible to the hand of the human wearing the vest.

3. Apparatus as claimed in claim 2, further comprising fasteners for securing the front portion of said vest.

4. Apparatus as claimed in claim 1 wherein said heating means and said vibrator means extend only over a portion of said vest.

5. Apparatus as claimed in claim 1 wherein said heating means and said vibrator means extend substantially over the entirety of said vest.

* * * * *